US011161132B2

(12) United States Patent
Maas et al.

(10) Patent No.: US 11,161,132 B2
(45) Date of Patent: Nov. 2, 2021

(54) DEVICE, SYSTEM AND METHOD FOR DISPENSING A LIQUID FROM A CONTAINER

(71) Applicant: Dispensing Technologies B.V., Helmond (NL)

(72) Inventors: Wilhelmus Johannes Joseph Maas, Someren (NL); Paulo Nervo, Hoogeloon (NL)

(73) Assignee: Dispensing Technologies B.V., Helmond (NL)

( * ) Notice: Subject to any disclaimer, the term of this patent is extended or adjusted under 35 U.S.C. 154(b) by 0 days.

(21) Appl. No.: 16/608,450

(22) PCT Filed: May 1, 2018

(86) PCT No.: PCT/EP2018/061076
§ 371 (c)(1),
(2) Date: Oct. 25, 2019

(87) PCT Pub. No.: WO2018/202645
PCT Pub. Date: Nov. 8, 2018

(65) Prior Publication Data

US 2020/0047203 A1 Feb. 13, 2020

(30) Foreign Application Priority Data

May 1, 2017 (NL) ..... 2018823

(51) Int. Cl.
*B05B 11/00* (2006.01)
*B05B 9/08* (2006.01)

(52) U.S. Cl.
CPC ..... *B05B 11/304* (2013.01); *B05B 9/0883* (2013.01); *B05B 11/0044* (2018.08);
(Continued)

(58) Field of Classification Search
CPC ..... B05B 11/0044; B05B 11/3011; B05B 11/304; B05B 11/3057; B05B 11/3063;
(Continued)

(56) References Cited

U.S. PATENT DOCUMENTS 3,753,518 A 8/1973 Kutik
5,560,520 A * 10/1996 Grogen ..... B05B 11/3016 222/321.2

(Continued)

FOREIGN PATENT DOCUMENTS

EP 0505900 A1 9/1992
JP H5-104040 A 4/1993
WO WO2017005938 A1 1/2017

OTHER PUBLICATIONS

Notification Concerning Transmittal of Copy on Patentability, IPRP and Written Opinion for PCT Application No. PCT/EP2018/061076 dated Nov. 14, 2019, 9 pages.

*Primary Examiner* — Vishal Pancholi
*Assistant Examiner* — Bob Zadeh
(74) *Attorney, Agent, or Firm* — Peter W. Schroen; Bret E. Field; Bozicevic, Field & Francis LLP

(57) ABSTRACT

The invention relates to a device (1) for dispensing a liquid from a container (C), comprising a pump (2) having a suction side (S) that is adapted to be brought into fluid communication with the container (C), a spray nozzle (3) in fluid communication with a pressure side (P) of the pump (2) through an outlet channel (4), a pre-compression valve (5) arranged in the outlet channel (4), and a gas buffer (9) in fluid communication with the pressure side (P) of the pump (2) and with the spray nozzle (3). The gas buffer (9) may comprise a buffer chamber (10) in which a gas-filled resiliently deformable body (11) is arranged, and the gas buffer (9) may extend from the pressure side (P) of the pump (2) in a different direction than the outlet channel (4). The invention further relates to a system for dispensing a liquid, comprising a container (C) that is filled with the liquid and a dispensing device (1) of the type described above connected to the container (C). And the invention relates to a method for dispensing a liquid, comprising the steps of:—

(Continued)

Figures 1, 2:
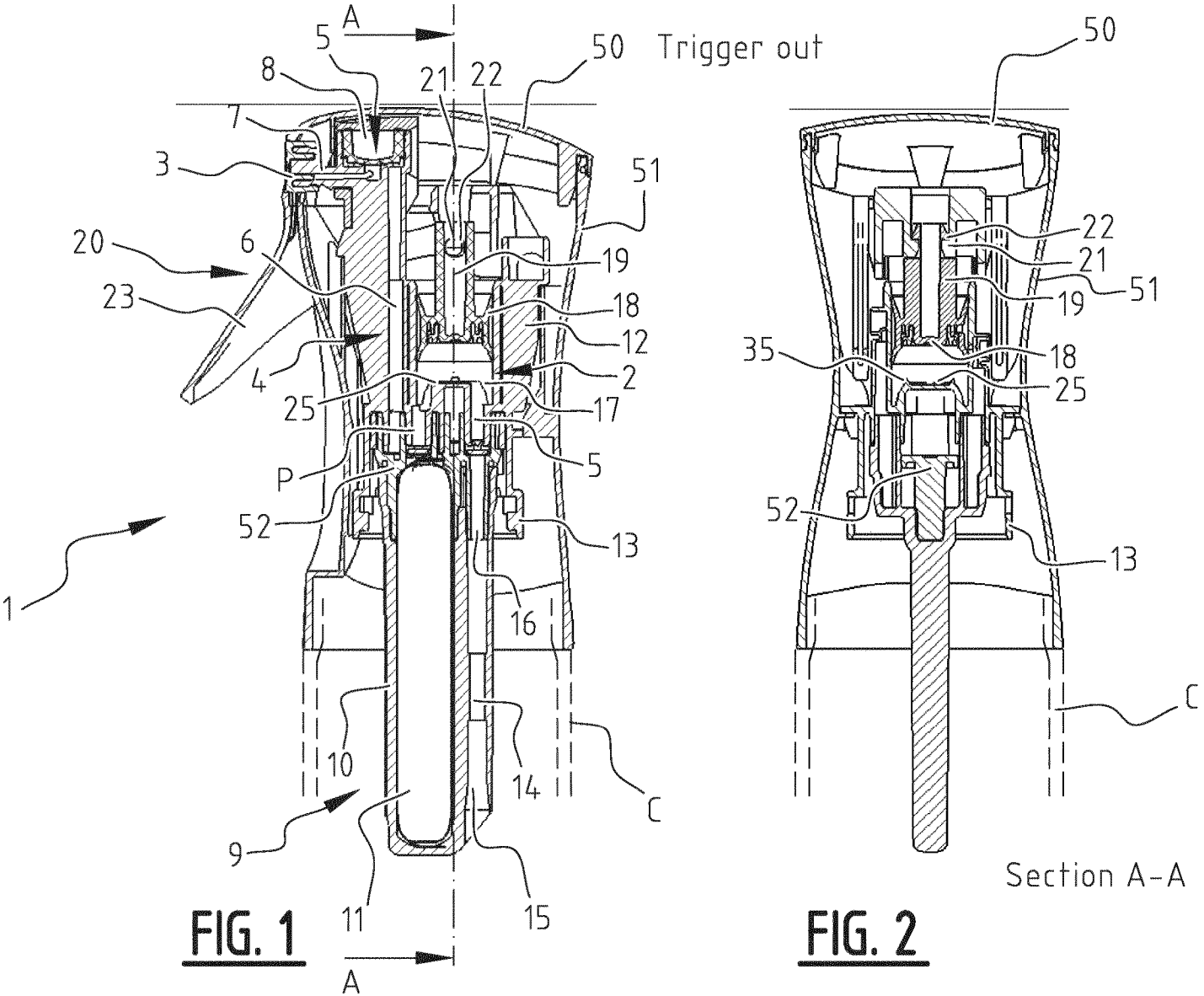

drawing the liquid from a container (C) and pressurizing the liquid by actuating a pump (2), wherein the container (C) and the pump (2) form part of a dispensing system;—guiding a part of the pressurized liquid to a spray nozzle (3) of the dispensing system;—spraying the liquid from the nozzle (3);—guiding another part of the pressurized liquid to a gas buffer (9) for temporary storage; and—spraying the stored liquid from the nozzle (3) when the pump (2) is not being actuated; wherein the pressurized liquid is guided from the pump (2) to the spray nozzle (3) in a different direction than from the pump (2) to the gas buffer (9).

20 Claims, 7 Drawing Sheets

(52) U.S. Cl.
CPC ..... *B05B 11/3011* (2013.01); *B05B 11/3063* (2013.01); *B05B 11/3078* (2013.01); *B05B 11/3057* (2013.01)

(58) Field of Classification Search
CPC ..... B05B 11/3078; B05B 9/0883; B05B 11/3038; B05B 11/3039
See application file for complete search history.

(56) References Cited

U.S. PATENT DOCUMENTS

2012/0048959 A1* 3/2012 Maas ..... B05B 9/0822 239/1
2014/0246506 A1* 9/2014 Maas ..... A47L 11/4088 239/1
2016/0228900 A1* 8/2016 Gonzalez ..... B05B 11/3057
2017/0072416 A1* 3/2017 Maas ..... B05B 11/304
2017/0121653 A1* 5/2017 Hoefte ..... C11D 1/66
2018/0318858 A1* 11/2018 Maas ..... B05B 7/0018
2020/0047203 A1* 2/2020 Maas ..... B05B 9/0883

* cited by examiner

Section C-C

Section A–A

DEVICE, SYSTEM AND METHOD FOR DISPENSING A LIQUID FROM A CONTAINER

The present invention relates to a device for dispensing a liquid from a container, comprising:

a pump having a suction side that is adapted to be brought into fluid communication with the container;

a spray nozzle in fluid communication with a pressure side of the pump through an outlet channel;

a pre-compression valve arranged in the outlet channel; and a gas buffer in fluid communication with the pressure side of the pump and with the spray nozzle;

wherein the gas buffer comprises a buffer chamber in which at least one gas-filled resiliently deformable body is arranged.

Such a dispensing device is known from WO 2014/074654 A1 of the present applicant. In this prior art dispensing device the gas buffer is arranged in the movable piston of the pump, and forms part of the outlet channel leading to the nozzle.

The invention has for its object to provide an improved dispensing device. In accordance with the invention, this is achieved by a dispensing device of the type discussed above wherein the gas buffer extends from the pressure side of the pump in a different direction than the outlet channel. By "decoupling" the gas buffer from the outlet channel the configurations of the buffer and the outlet channel can be individually optimized. Such "decoupling" further allows the buffer to be produced separately from the pump and/or the spray nozzle and to be assembled at a later moment and/or at a different location. Moreover, in this way the size of the buffer can be varied independently of the dimensions of the pump.

It should be noted that a dispensing device having such a general arrangement is described in pending application PCT/NL2016/050756 by the present applicant, which has not been published yet. However, that earlier application relates to a device for dispensing foam, which includes a nozzle that is specially designed for foaming. The present application, on the other hand, relates exclusively to a device for spraying a liquid, i.e. creating droplets or a mist of liquid. Devices for dispensing a foam are explicitly disclaimed.

In one embodiment of the invention, the gas buffer extends from the pressure side of the pump in substantially opposite direction to the outlet channel. In this way the outlet channel can be arranged alongside the pump, while the buffer can be arranged opposite the pump.

In that case, the gas buffer may extend from the pressure side of the pump in the direction of the container. This may result in an efficient "packaging" of the various components of the device. When the dispensing device further comprises an annular connector for establishing a mechanical connection between the device and a neck of the container, the gas buffer may extend through the annular connector. In this way the gas buffer may extend into the neck portion of the container.

When the gas buffer includes at least one opening for establishing the fluid communication with the pressure side of the pump and with the spray nozzle, this opening may be arranged in a part of the buffer facing the pump. Since the gas buffer is decoupled from the outlet channel, there is no need for openings in opposite ends of the buffer chamber as in the prior art device.

When the buffer chamber is coupled to the pump and the spray nozzle by means of a coupling part, the at least one opening may be formed in the coupling part. In this way production and assembly of the gas buffer is greatly simplified.

The pre-compression valve and the gas buffer may be arranged to define lower and upper limits, respectively, of a dispensing pressure of the spray. In that case the lower limit of the dispensing pressure is the cracking pressure of the pre-compression valve, i.e. the pressure at which the valve opens and closes, while the upper limit is the maximum pressure that can be exerted by the gas in the buffer.

In one embodiment, the pre-compression valve may have a cracking pressure of about 2 to 4.5 bar, preferably about 3 to 3.5 bar. At these values of the cracking pressure dripping of the liquid can be effectively prevented.

In another embodiment the gas buffer may define a maximum value of the dispensing pressure of between 3 and 6.5 bar, preferably between 5 and 6 bar. At these pressures the droplets forming the spray are still large enough to form a well-defined spray, without any risk of unwanted dispersion and possible inhalation.

In order to optimize the use of space within the dispensing device, the at least one gas-filled resiliently deformable body may substantially fill the buffer chamber.

A structurally simple embodiment, which is easy to manufacture by injection moulding, is obtained when the buffer chamber and the at least one gas-filled resiliently deformable body are each substantially tubular.

In such an embodiment the at least one gas-filled resiliently deformable body may comprise a tube that is welded shut at both ends. In this way an enclosed space is defined, which can then be filled with a gas. The tube can be a multi-layer tube containing for example PE, EVOH, or Yparex. It is pressurized by filling with a gas such as, for example, air, nitrogen or other gasses.

In order to obtain an optimum resistance to internal pressurization, the buffer chamber may have rounded ends and the welded ends of the tube may be folded to a rounded shape.

In one embodiment of the dispensing device the pump may include a priming and/or venting mechanism. This allows the pump to be primed before first use, and further allows air to be removed from the system during operation.

When the pump comprises a pump chamber and a piston that is movable therein, the priming and/or venting mechanism may include a protrusion in the pump chamber for cooperation with a deformable part of the piston.

The invention further relates to a system for dispensing a liquid, comprising a container that is at least partially filled with the liquid and a dispensing device of the type described above which is connected to the container.

Moreover, the invention relates to a method for dispensing a liquid. The above-identified prior art document WO 2014/074654 A1 already discloses a method which comprises the steps of:

- drawing the liquid from a container and pressurizing the liquid by actuating a pump, wherein the container and the pump form part of a dispensing system;
- guiding at least a part of the pressurized liquid to a spray nozzle of the dispensing system;
- spraying the liquid from the nozzle;
- guiding another part of the pressurized liquid to a gas buffer for temporary storage; and
- spraying the stored liquid from the nozzle when the pump is not being actuated.

The invention provides an improved method, in which the pressurized liquid is guided from the pump to the spray nozzle in a different direction than from the pump to the gas buffer.

In one embodiment of the method the pressurized liquid is guided from the pump to the spray nozzle in a direction that is substantially opposite to the direction in which the pressurized liquid is guided from the pump to the gas buffer.

Figure 3:
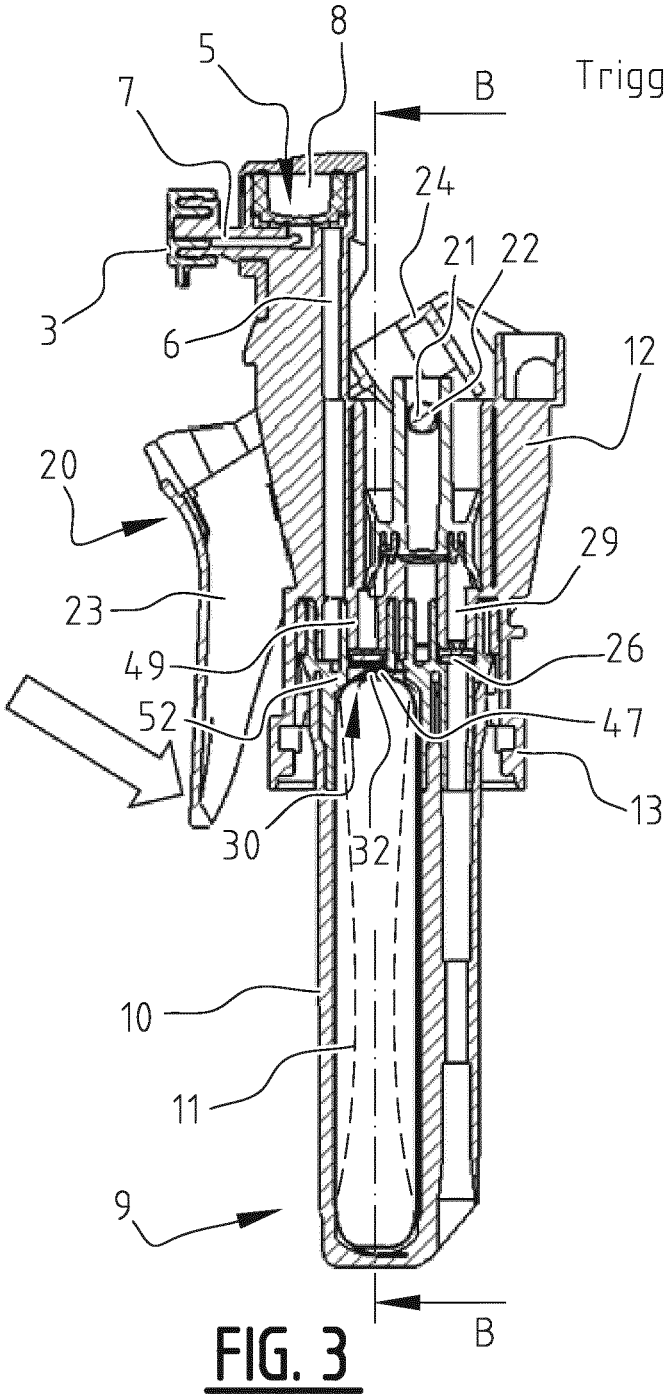
Figure 4:
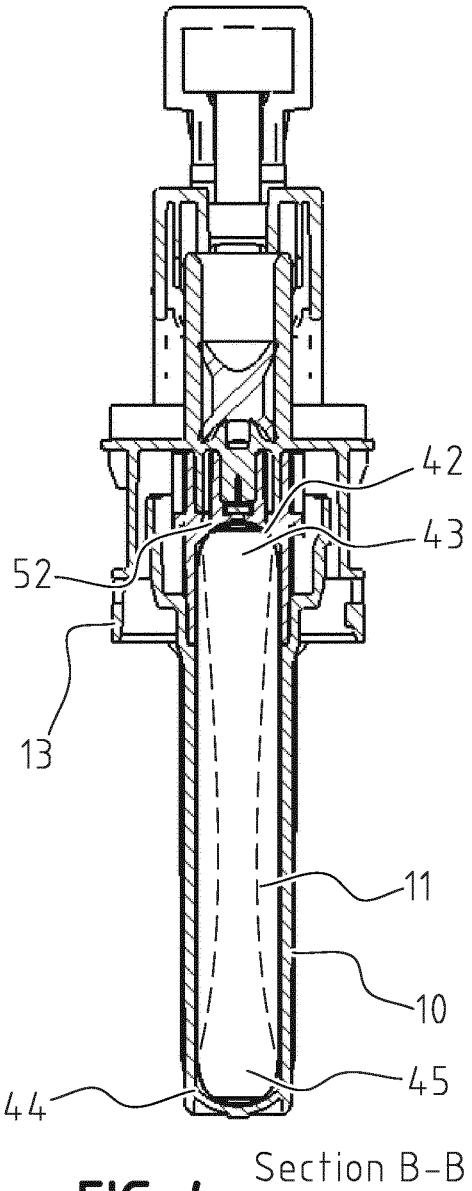
Figure 5:
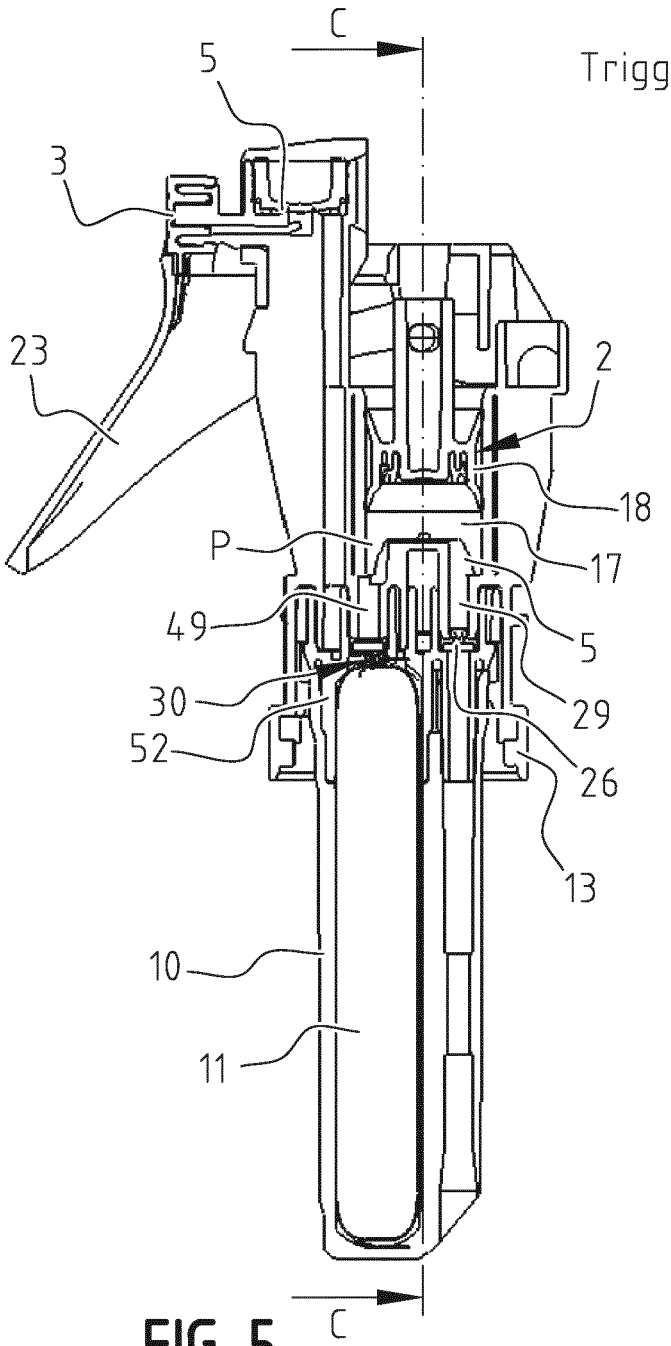
Figure 6:
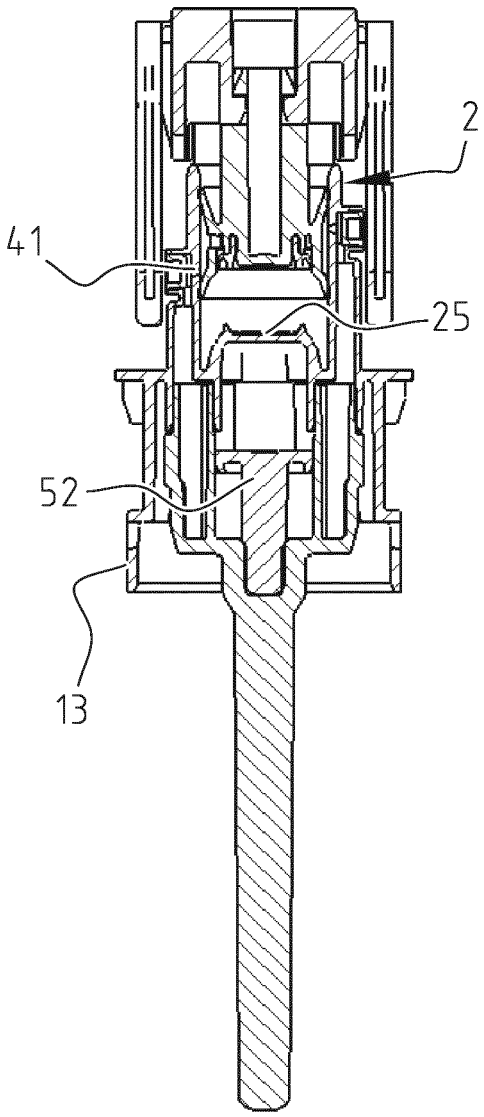
Figure 7:
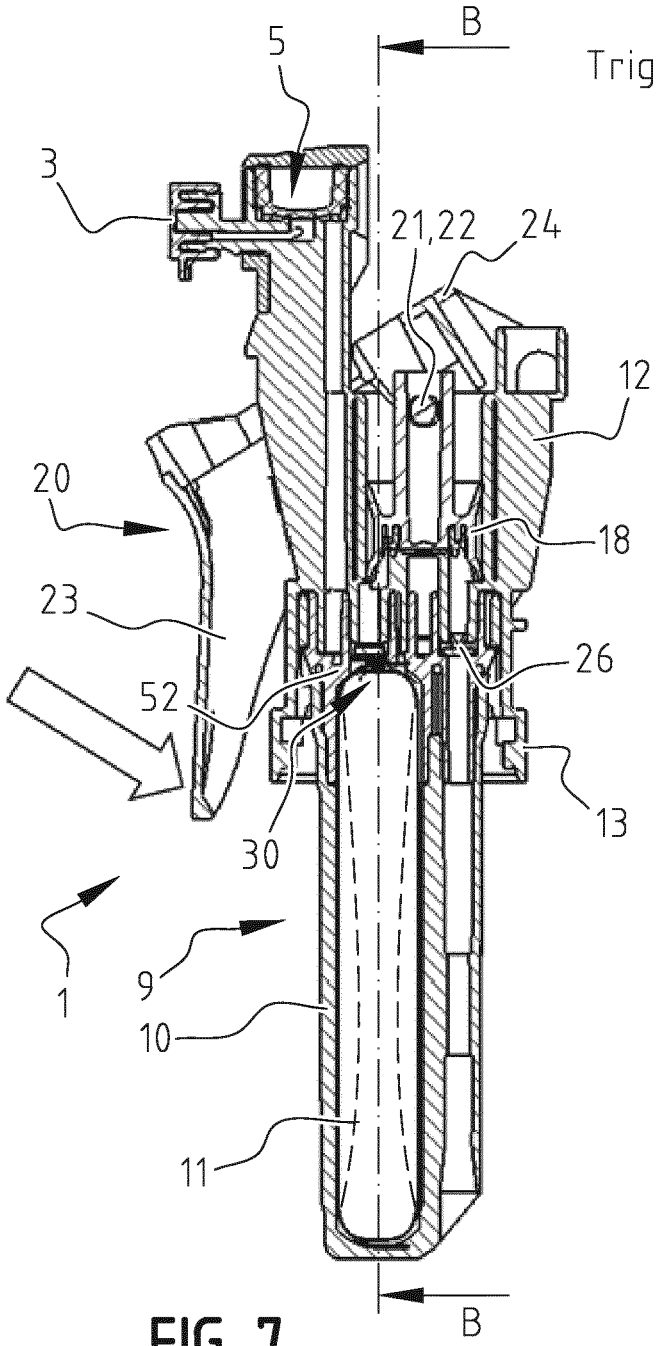
Figure 8:
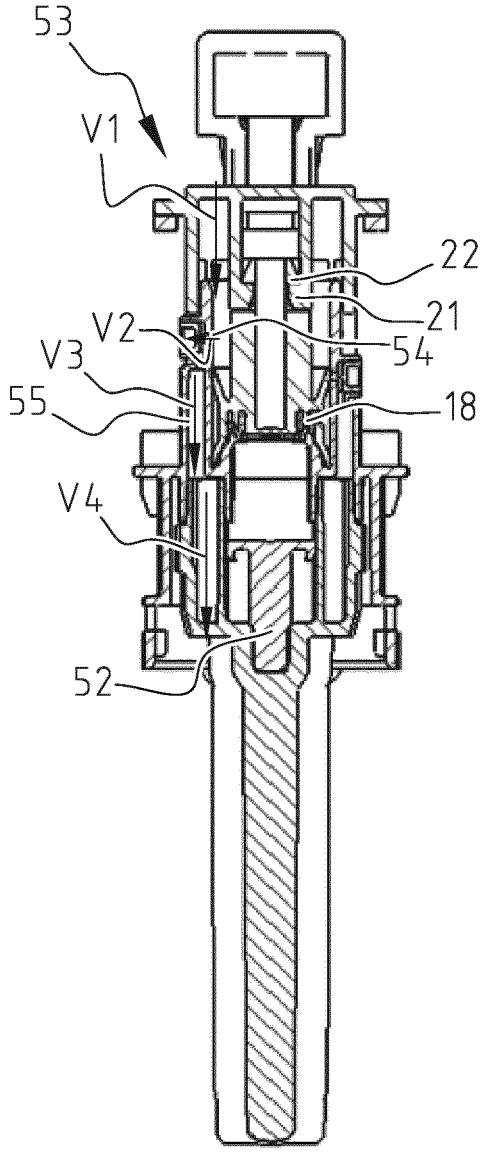
Figure 11:
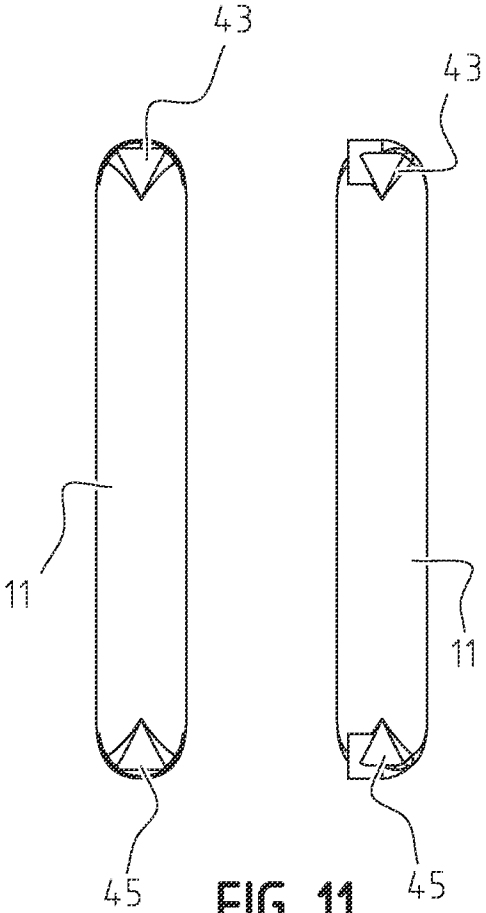
Figure 10:
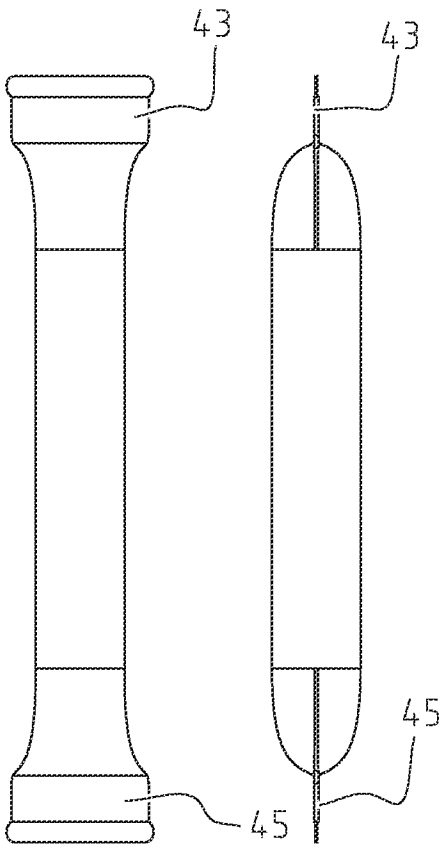
Figure 9:
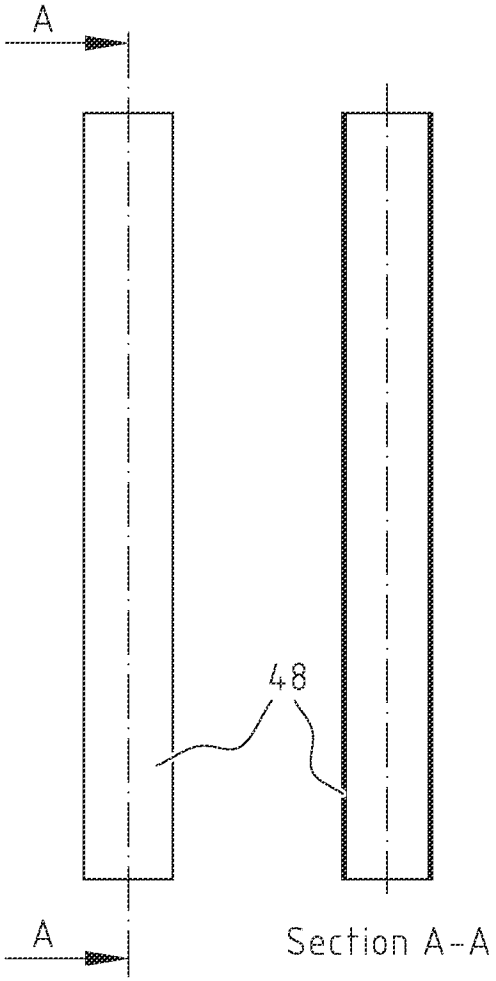
Figure 12:
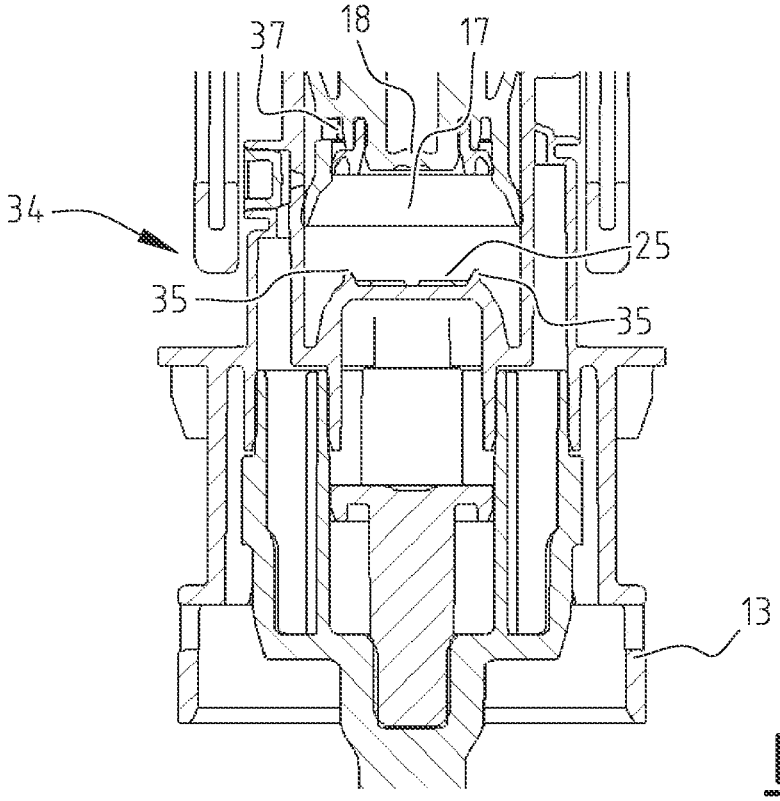
Figure 13:
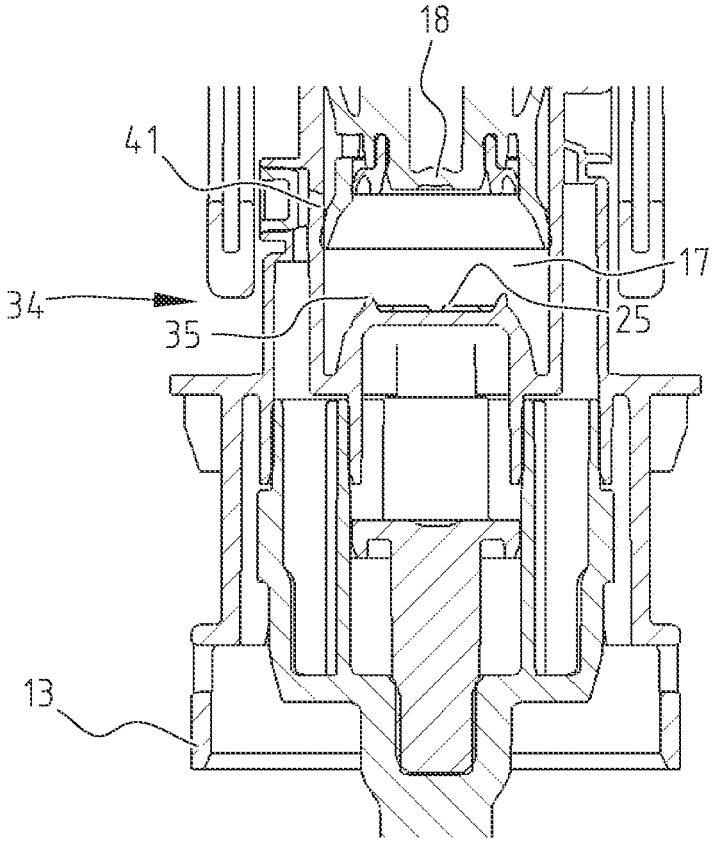
Figure 14:
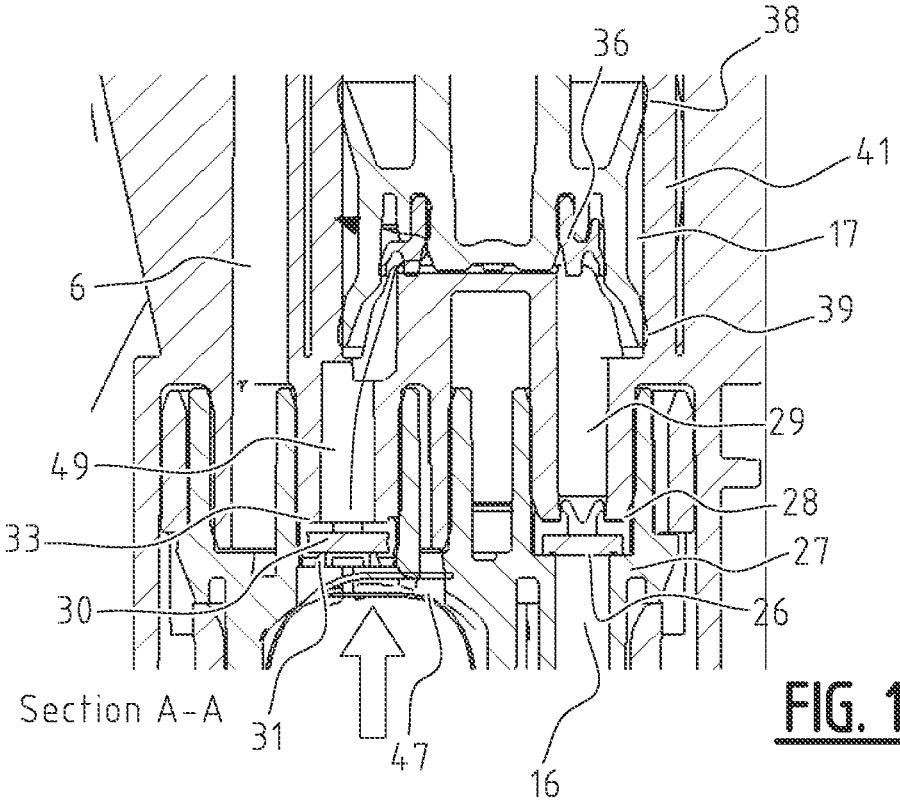
Figure 15:
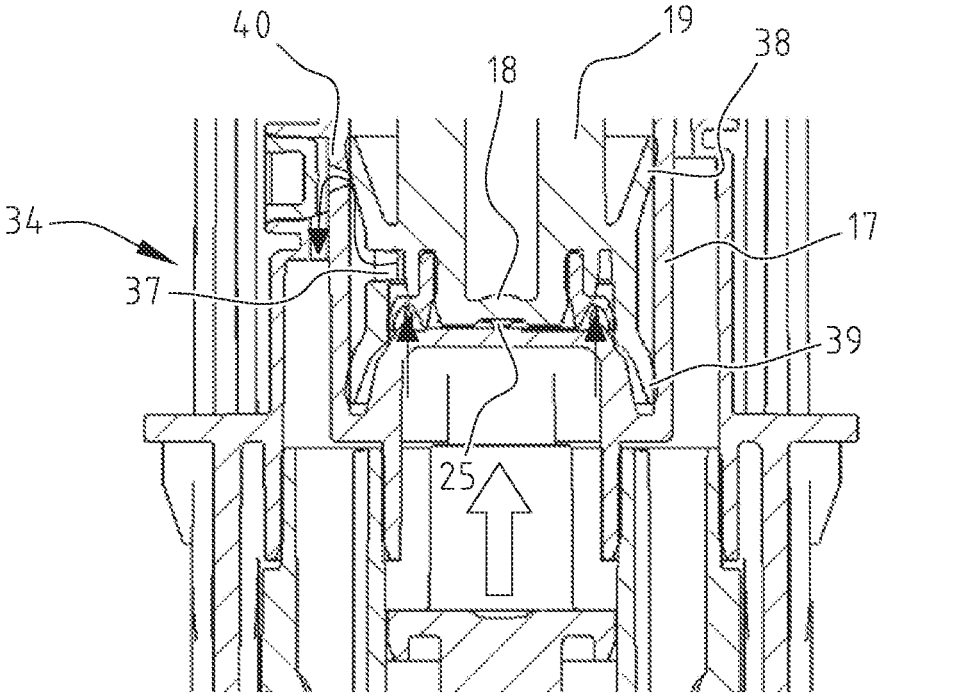

The invention will now be illustrated by way of two examples, with reference being made to the annexed drawings, in which similar parts have the same reference numerals, and in which:

FIG. 1 is a longitudinal sectional view of a first embodiment of a dispensing device of the invention when the pump is not actuated, with part of a container being schematically represented in dashed lines, FIG. 2 is a cross-sectional view of the device of FIG. 1 taken along the line A-A, FIG. 3 is a longitudinal sectional view of the device of FIG. 1 with the shroud removed, in a situation where the trigger has been depressed and the pump actuated, FIG. 4 is a cross-sectional view of the device of FIG. 3 taken along the line B-B, FIG. 5 is a longitudinal sectional view of a second embodiment of a dispensing device of the invention when the pump is not actuated, FIG. 6 is a cross-sectional view of the device of FIG. 5 taken along the line C-C, FIG. 7 is a longitudinal sectional view of the device of FIG. 5 in a situation where the trigger has been depressed and the pump actuated, FIG. 8 is a cross-sectional view of the device of FIG. 7 taken along the line B-B, FIGS. 9-11 show various stages of the manufacture of a gas-filled resiliently deformable body both in front view and in cross-sectional view along the line A-A, FIGS. 12 and 13 show an enlarged detail view of part XII of FIG. 6, illustrating various elements of the priming and/or venting mechanism, FIG. 14 is an enlarged detail view of part XIV of FIG. 7, showing how pressurized air may escape through the piston, and FIG. 15 is an enlarged detail view of part XV of FIG. 8, showing how pressurized air may escape from the pump chamber.

A device 1 for dispensing a liquid (not shown) from a container C (shown in phantom), comprises a pump 2 having a suction side S that is adapted to be brought into fluid communication with the container C. The dispensing device 1 further comprises a spray nozzle 3 which is in fluid communication with a pressure side P of the pump 2 through an outlet channel 4. The nozzle 3 is only suitable for spraying the liquid, and has no foaming properties. A separate screen may be arranged in front of the nozzle 3 if foaming is required.

A pre-compression valve 5 is arranged in the outlet channel 4 between a vertical part 6 originating near the pressure side P of the pump 2 and a horizontal part 7 leading to the spray nozzle 3. In this embodiment the pre-compression valve 5 is a dome valve carried by an integral sleeve, which is arranged in a valve chamber 8. The pre-compression valve 5 has a cracking pressure which defines a lower limit of the pressure at which the liquid is sprayed.

The dispensing device 1 further comprises a gas buffer 9 which is in fluid communication with both the pressure side P of the pump 2 and with the spray nozzle 3. The gas buffer 9 comprises a lower part 10 forming a buffer chamber in which a gas-filled resiliently deformable body 11 is arranged and an upper part 52 coupling the buffer chamber 10 with a frame 12 to be discussed below. As is clearly shown in FIG. 1, the gas buffer 9 extends from the pressure side P of the pump 2 in a different direction than the outlet channel 4. In fact, in this embodiment the vertical part 6 of the outlet channel 4 extends upwardly alongside the pump 2, while the gas buffer 9 extends substantially vertically in a downward direction, opposite to the outlet channel 4.

In this embodiment, the pump 2 includes a pump chamber 17 which is integrally formed with the frame 12. The frame 12 includes an annular connector 13 for establishing a mechanical connection with a neck part (not shown) of the container C. The gas buffer 9 extends through this annular connector 13 into the neck part of the container C. In this case, the buffer chamber 10 is integrally formed with an inlet channel 14 having a widened part 15 which allows a dip tube (not shown) to be connected to the inlet channel 14. The buffer chamber 10 is mounted on the bottom of the frame 12, such that it is substantially in line with the pressure side P of the pump 2, while the inlet channel 14 is in line with an inlet 16 at the suction side S of the pump 2.

The pump 2 further includes a piston 18 which slidingly reciprocates in the pump chamber 17. The piston 18 includes a standing piston rod 19 which is pivotally connected to an actuator 20 by means of a pin 21 extending through a hole 22. The actuator includes a trigger 23 and a bracket 24 which is pivotally connected to the rear of the frame 12. Depressing the trigger 23 moves the piston 18 and the pump chamber 17 with respect to each other, so that the piston approaches a bottom 25 of the pump chamber 17, as evidenced by comparing FIGS. 1 and 3. The trigger 23 is returned to its position of rest as shown in FIG. 1 by a spring mechanism which is not shown here.

The frame 12 including the pump 2, and the actuator 20 including the trigger 23 and bracket 24 are covered by a two-piece shroud 50, 51.

The suction side S of the pump 2 includes the inlet 16 and an inlet valve 26, which is movable between a lower valve seat 27 on the inlet 16 and an upper valve seat 28 at an inlet opening 29 of the pump chamber 17. The upper valve seat 28 is serrated, allowing liquid to pass the inlet valve 26 when it lies against the upper valve seat 28 and be drawn into the pump chamber 17.

In similar fashion, the pressure side P of the pump 2 includes an outlet opening 49 and an outlet valve 30, which is movable between a lower valve seat 31 on an inlet 32 of the coupling part 52 of the buffer 9 and an upper valve seat 33 at the outlet opening 49 of the pump chamber 17. Here the lower valve seat 31 is serrated, allowing pressurized liquid to pass the outlet valve 30 when it lies on the lower valve seat 31 and flow into the buffer chamber 10.

The pump 2 may include a priming mechanism 34. The priming mechanism 34 includes two protrusions 35 on the bottom 25 of the pump chamber 17, which act on a deformable inner annulus 36 in a lower surface of the piston 18 (FIGS. 12, 13). This allows air to escape through a venting hole 37 of the piston into a space between upper and lower edges 38, 39 of the piston 18 (FIG. 14). From there the air may escape through a venting hole 40 which is formed in a sidewall 41 of the piston chamber 17 at a position which lies between the upper and lower edges 38, 39 when the piston 18 is at the end of a downward stroke. This mechanism 34 allows air to which is trapped in the piston chamber 17 after assembly of the dispensing device 1 and container C to be removed at the first downward stroke(s) of the piston 18, thus priming the pump 2 for future use.

The pump may further include a venting mechanism 53. This is particularly important when the container C is a regular single wall container. When the container C is a bag-in-bottle container like a Flair® container, venting is not necessary. The venting mechanism 53 includes a second venting hole 54 formed in the sidewall 41 of the piston chamber 17 at a position which lies above the upper edge 38 of the piston 18 when the latter is at the end of its downward stroke (FIG. 8). The second venting hole 54 lies above the venting hole 40 of the priming mechanism 34. Ambient air may enter the device 1 from the top and may flow through the upper part of the piston chamber 17 and through the second venting hole 54 into a space 55 surrounding the piston chamber 17. From there the air will flow between the buffer 9 and the annular connector 13 into the container C, as illustrated by arrows V1-V4 in FIG. 8.

In this embodiment the buffer chamber 10 is substantially tubular, and so is the gas-filled body 11. Both the buffer chamber 10 and the gas-filled body 11 have rounded upper and lower ends 42, 43 and 44, 45, respectively. The gas-filled body 11 lies snugly against the cylindrical sidewall 46 of the buffer chamber 10 so that it substantially fills the entire volume of the buffer chamber 10 when no liquid is present.

When the trigger 23 is depressed for the first time, any air that is present in the pump chamber 2 will be removed by the venting mechanism 34 described above. Then, when the trigger 23 is returned to its position of rest, a partial vacuum will be established by the resulting upward movement of the piston 18 in the piston chamber, thus drawing liquid from the container C through the inlet channel 14 and the inlet 16, past the inlet valve 26 and through the inlet opening 29 into the pump chamber 17. At the same time, this partial vacuum will suck the outlet valve 30 onto the upper valve seat 33, thus closing off the outlet opening 49 and disconnecting the buffer chamber 10 and outlet channel 4 from the pump chamber 17. In this way the piston chamber 17 is entirely filled with liquid.

When the trigger 23 is depressed again, the pressure in the pump chamber 17 rises instantly, since liquid is incompressible. This pressure rise will force the inlet valve 26 onto the lower valve seat 27, thus closing off the inlet 16 and disconnecting the pump 2 from the container C. At the same time the outlet valve 30 will be forced onto its lower valve seat 31 so as to open the outlet opening 49 and allow the pressurized liquid to enter the top of the buffer chamber 10 through the inlet 32.

The top of the buffer chamber 10 is in direct fluid communication with the outlet channel 4 through an outlet 47 which does not have any valve. And since the pressure of the gas inside the body 11 is higher than the cracking pressure of the pre-compression valve 5, the pressurized liquid will first flow from the inlet 32 directly to the outlet 47 and from there through vertical part 6 of outlet channel 4, past the pre-compression valve 5 and through the horizontal part 7 towards the spray nozzle 3.

However, the capacity of the pump 2 has been designed to be greater than the maximum throughput of the spray nozzle 3, so that the pressure in the outlet channel 4 will continue to rise during the downward stroke of the piston 18. Eventually, the pressure will become so high that pressurized liquid will be forced into the buffer chamber 10, to penetrate between the sidewall 46 and the gas-filled body 11.

When pressurized liquid from the pump 2 enters the buffer chamber 10 during a pump stroke of the dispensing device 1, the gas-filled body 11 is compressed, thus increasing the internal pressure of the gas in the body 11. This compression leads to deformation of the body 11, as indicated by dashed lines in the drawings. When the end of the pump stroke is reached and the trigger 23 is returned to its position of rest, the gas pressure in the buffer 9 acts on the liquid and forces it out of the buffer chamber 10 towards the spray nozzle 3. In this way spraying is continued, even while the trigger is not actuated. This allows continuous spraying action to be achieved, more or less like an aerosol.

The gas-filled body 11, which is made of resilient or flexible material, resumes its original shape in which it fills the buffer chamber 10. As the rounded top 44 of the gas-filled body 11 is comparatively stiffer than its tubular sidewall, this top will remain more or less stationary, thus preventing the gas-filled body 11 from being crumpled in the buffer chamber 10.

In the present embodiment the gas-filled body 11 is made from a tube 48 of resilient or flexible material (FIG. 9), which is welded shut at its ends 44, 45 (FIG. 10). The welded ends 44, 45 are then folded into hemispherical shapes (FIG. 11). The body 11 can be filled with pressurized gas after one of the ends has been welded, but it is also conceivable that the tube is immersed in a gas-filled space and welded there.

The buffered sprayer of the invention allows a liquid to be sprayed in a continuous flow by subsequent operation of the trigger. Because the buffer includes a gas-filled plastic body, rather than a metal spring, the device can be manufactured easily and at reduced costs, and is also easy to recycle. It further has a much smaller carbon footprint than convention devices. And due to the arrangement of the buffer opposite the outlet channel the "packaging" of the parts is efficient, allowing a compact design, while the liquid flow to the nozzle is also optimized.

Although the invention has been described here by way of some examples, it will be clear that it may be varied in many ways within the scope of the following claims.

The invention claimed is:

1. A dispensing device for dispensing a liquid from a container, comprising:

a pump having a suction side that is adapted to be brought into fluid communication with the container;

a spray nozzle in fluid communication with a pressure side of the pump through an outlet channel;

a pre-compression valve arranged in the outlet channel;

a gas buffer in fluid communication with the pressure side of the pump and with the spray nozzle; and an annular connector for establishing a mechanical connection between the device and a neck of the container;

wherein the gas buffer comprises a buffer chamber in which at least one gas-filled resiliently deformable body is arranged; and wherein the gas buffer extends from the pressure side of the pump in a different direction than the outlet channel, the gas buffer extending in the direction of the container and through the annular connector.

2. The dispensing device according to claim 1, wherein the gas buffer extends from the pressure side of the pump in opposite direction to the outlet channel.

3. The dispensing device according to claim 1, wherein the gas buffer includes at least one opening for establishing the fluid communication with the pressure side of the pump and with the spray nozzle, the at least one opening being arranged in a part of the gas buffer facing the pump.

4. The dispensing device according to claim 3, wherein the buffer chamber is coupled to the pump and the spray nozzle by means of a coupling part, and wherein the at least one opening is formed in the coupling part.

5. The dispensing device according to claim 1, wherein the pre-compression valve and the gas buffer are arranged to define lower and upper limits, respectively, of a dispensing pressure of the spray.

6. The dispensing device according to claim 5, wherein the gas buffer defines a maximum value of the dispensing pressure of between 3 and 6.5 bar.

7. The dispensing device according to claim 6, wherein the gas buffer defines a maximum value of the dispensing pressure of between 5 and 6 bar.

8. The dispensing device according to claim 1, wherein the pre-compression valve has a cracking pressure of about 2 to 4.5 bar.

9. The dispensing device according to claim 8, wherein the pre-compression valve has a cracking pressure of about 3 to 3.5 bar.

10. The dispensing device according to claim 1, wherein the at least one gas-filled resiliently deformable body fills the buffer chamber.

11. The dispensing device according to claim 10, wherein the buffer chamber and the at least one gas-filled resiliently deformable body are each tubular.

12. The dispensing device according to claim 11, wherein the at least one gas-filled resiliently deformable body comprises a tube that is welded shut at both ends.

13. The dispensing device according to claim 12, wherein the buffer chamber has rounded ends and the welded ends of the tube are folded to a rounded shape.

14. The dispensing device according to claim 1, wherein the pump includes a priming and/or venting mechanism.

15. The dispensing device according to claim 14, wherein the pump comprises a pump chamber and a piston that is movable therein, and wherein the priming and/or venting mechanism includes a protrusion in the pump chamber for cooperation with a deformable part of the piston.

16. A system for dispensing a liquid, comprising a container that is at least partially filled with the liquid and a dispensing device according to claim 1 connected to the container.

17. A method for dispensing a liquid, comprising the steps of:

drawing the liquid from a container and pressurizing the liquid by actuating a pump, wherein the container and the pump form part of a dispensing system;

guiding at least a part of the pressurized liquid to a spray nozzle of the dispensing system;

spraying the liquid from the nozzle;

guiding another part of the pressurized liquid to a gas buffer for temporary storage; and spraying the stored liquid from the nozzle when the pump is not being actuated;

wherein the pressurized liquid is guided from the pump to the spray nozzle in a different direction than from the pump to the gas buffer, the part of the pressurized liquid guided to the gas buffer for temporary storage being guided in the direction of the container and through an annular connector for establishing a mechanical connection between the pump and a neck of the container.

18. The method according to claim 17, wherein the pressurized liquid is guided from the pump to the spray nozzle in a direction that is opposite to the direction in which the pressurized liquid is guided from the pump to the gas buffer.

19. A dispensing device for dispensing a liquid from a container, comprising:

a pump having a suction side that is adapted to be brought into fluid communication with the container;

a spray nozzle in fluid communication with a pressure side of the pump through an outlet channel;

a pre-compression valve arranged in the outlet channel; and a gas buffer in fluid communication with the pressure side of the pump and with the spray nozzle;

wherein the gas buffer comprises a buffer chamber in which at least one gas-filled resiliently deformable body is arranged;

wherein the gas buffer extends from the pressure side of the pump in a different direction than the outlet channel;

wherein the gas buffer includes at least one opening for establishing the fluid communication with the pressure side of the pump and with the spray nozzle, the at least one opening being arranged in a part of the gas buffer facing the pump; and wherein the buffer chamber is coupled to the pump and the spray nozzle by means of a coupling part, and wherein the at least one opening is formed in the coupling part.

20. A system for dispensing a liquid, comprising a container that is at least partially filled with the liquid and a dispensing device according to claim 19 connected to the container.

* * * * *